US005399117A

United States Patent [19]

Telford

[11] Patent Number: 5,399,117

[45] Date of Patent: Mar. 21, 1995

[54] NIPPER TOOL TO AID OYSTER SHUCKING

[76] Inventor: Frank M. Telford, 928 N. Western Ave., Wentachee, Wash. 98901

[21] Appl. No.: 262,504

[22] Filed: Jun. 20, 1994

[51] Int. Cl.[6] ..... A22C 29/04

[52] U.S. Cl. ..... 452/17; 452/13; 30/183; 30/184; 30/120.1

[58] Field of Search ..... 452/17, 13, 16; 30/28, 30/175, 182, 183, 184, 120.1, 120.2, 120.5

[56] References Cited

U.S. PATENT DOCUMENTS

| | | | |
|---|---|---|---|
| 18,273 | 9/1857 | Beach . | |
| 54,566 | 5/1866 | Lyon . | |
| 112,585 | 5/1871 | Boyer . | |
| 144,063 | 10/1873 | Cleary . | |
| D. 159,096 | 6/1950 | Plock . | |
| 159,598 | 2/1875 | Megee . | |
| 162,606 | 4/1875 | Berger . | |
| 177,138 | 5/1876 | Lum et al. . | |
| 211,449 | 1/1879 | Wells . | |
| 408,039 | 8/1889 | Thompson . | |
| 469,312 | 2/1892 | Wood | 452/17 |
| 546,329 | 8/1895 | Zucchhi . | |
| 708,014 | 9/1902 | Blagden | 452/17 |
| 715,988 | 12/1902 | Cooley et al. . | |
| 805,257 | 11/1905 | Brooks | 30/183 |
| 1,007,411 | 10/1911 | Zimmers . | |
| 1,232,682 | 7/1917 | Hartleb et al. . | |
| 1,510,313 | 9/1924 | Dickerson . | |
| 1,597,622 | 8/1926 | Richens . | |
| 1,663,758 | 3/1928 | Gwisdalla . | |
| 2,299,311 | 10/1942 | Dickerson . | |
| 2,343,953 | 3/1944 | Canthns | 30/184 |
| 2,444,636 | 7/1948 | Dickerson . | |
| 2,591,409 | 4/1952 | Dahl | 30/183 |
| 3,303,527 | 2/1967 | Lanier . | |
| 3,840,940 | 10/1974 | Briddel et al. . | |
| 3,846,908 | 11/1974 | Allievl . | |
| 3,934,311 | 1/1976 | Thompson . | |
| 4,304,029 | 12/1981 | Cox | 452/13 |
| 5,145,448 | 9/1992 | Ebisuzaki | 452/13 |

FOREIGN PATENT DOCUMENTS

| | | |
|---|---|---|
| 2480103 | 10/1981 | France . |
| 2415989 | 8/1989 | France . |

*Primary Examiner*—Willis Little

*Attorney, Agent, or Firm*—Keith S. Bergman

[57] ABSTRACT

A nipper tool to remove a peripheral portion of the lip of a bivalve mollusk shell, and especially the shell of an oyster, to aid opening with a shucking knife provides a peripherally defined angulated handle structurally interconnecting a peripherally defined cylindrical nipping body. The nipping body defines an insertion notch in its lower forward portion distal from the handle to provide access to the nipping body chamber which slidably carries a nipper plunger with depending nipper blade to nip the lip of an oyster in the insertion notch. The nipper plunger is biased downwardly in the nipper body chamber by a compression spring and movable against this bias by a bell crank extending into the handle structure. A first manually operated species provides a pivotally movable lever adjacent the handle, with linkage to the bell crank to move the nipper plunger against its bias and release it to nip an oyster shell lip. A second power operated species provides a switch operated, electrically powered mechanism linked to the bell crank to move the nipper plunger in the same fashion.

5 Claims, 3 Drawing Sheets

NIPPER TOOL TO AID OYSTER SHUCKING

BACKGROUND OF INVENTION

1. RELATED APPLICATIONS

There are no applications related hereto heretofore filed in this or any foreign country.

2. FIELD OF INVENTION

My invention relates generally to the butchering of bivalve mollusks, and more particularly to a blade type nipper tool to notch the ventral lip of an oyster shell to aid subsequent insertion of a shucking knife.

DESCRIPTION OF PRIOR ART

Commonly an oyster provides a shell having two similar valves overlying a mantle which joins them on the anterior and dorsal sides but leaves the ventral edges free. A large adductor muscle of fairly complex structure and function controls motion of the valves and locks them together. The adductor muscle is quite strong. It can provide a continuous pull of about twenty-two pounds for up to about an hour and can provide a force of a few pounds for several days. Generally a force of from twenty-five to thirty-five pounds is required to tear the adductor muscle from the valves. The ventral edges of the valves generally are quite tight fitting and configurationally define somewhat of a crenate crinkled edge.

Although oysters are and have been a gastronomic delicacy for most peoples from times immemorial, their anatomical structure and physiological nature have presented problems in opening the valves to obtain the oyster meat. Responsively, many and various mechanical devices and methods have become known to aid in shucking oysters. One type of such device has crushed or broken the oyster shell over substantial areas such as by impact of a pounding device to aid subsequent shucking. This type of device has not become particularly popular because it tends to generate small pieces of shell that are difficult to remove from the oyster meat, and it still remains difficult to separate the meat from the crushed shell. Because of the strength and tonus of the oyster's adductor muscle, the most popular and commonly used methods of oyster shucking have involved the use of a knife of some sort to sever or tear smaller portions of the adductor muscle from the interconnected valves. This operation, however, necessarily requires the insertion of a knife or similar device within the oyster shell to accomplish its ends and such insertion itself is difficult.

The oyster shell not only is tightly closed along its ventral edge or lip, but the connecting portions of the valves in this area generally are of irregular shape to often make the insertion of a knife-like tool having appropriate size quite difficult. A group of tools commonly called nippers have heretofore become known to remove a portion from the ventral lip of an oyster shell to provide an area where a knife may be more easily inserted for subsequent shucking of the oyster. The instant invention provides a new and novel member of this class of device that addresses problems previously unresolved in prior devices of the same class.

Known nippers generally may be divided into two classes or types. A first class of nippers has provided a plier or nut cracker type structure defining two jaw elements which are mechanically moved toward each other, normally with some mechanical leverage, to remove a portion of an oyster shell lip. These devices commonly have been manually operated at a relatively low speed so that their action in removing shell portions is primarily by reason of pressure applied between the jaws and is not caused by an impact type force. Since the oyster shell is a relatively hard calcareous structure that offers substantial resistance to compression, the force required for removal of a shell portion by this method is substantial.

To exacerbate this problem, many plier type nippers have provided blade or jaw structures that are of a more or less lineal configuration and of some substantial length. Such jaws require more force to accomplish their purpose than would a jaw having a shorter length of contact with an oyster shell. The lineal configuration of such jaws also tends to apply all force at a position spacedly inwardly of an oyster lip which is not so efficient in fracturing a portion of that shell lip as a force applied by a jaw having a configuration wherein the end portions extend to or over the edge of the lip. The instant apparatus is distinguished from such prior art by providing a nipper jaw that has minimal contact area with the lip of an oyster shell to accomplish its function and which has a force applying element that has a shape such that it intersects the outer lip edge of an oyster shell on both sides of an area to be nipped from that shell.

The instant apparatus is further distinguished from the plier type nippers in that it provides force upon the area of an oyster shell to be nipped over a relatively short period of time so that the severance or breaking of the nipped portion is accomplished, not only by physical force upon the shell, but also by reason of impact force generated on the shell by the nipping element. The calcareous nature of an oyster shell and its particular structure is more susceptible to fracture and fragmentation by reason of impact forces than by reason of slowly and directly applied compressive forces.

The impact type force of my device is generated by compression and subsequent release of a spring. Various compressive springs have been used in prior oyster nippers, but in general those springs have been used to bias the nipping means to a particular portion, commonly an opened position, rather than to impart impact type forces to a shell lip. In such prior devices the biasing spring merely absorbs force that could otherwise be applied to nipping, whereas the instant spring is compressed and the kinetic energy used to move the nipper to better and more efficiently shatter and break the portion of the shell that is nipped. In one prior device which did use the kinetic energy of a spring to drive a nipper, the linkage associated with the spring does not provide for smooth and continuous operation that would minimize wear and maintenance so as to make the mechanism practically useful.

Various powered oyster nippers have heretofore become known but in general, those nippers have been designed for continuous industrial use. Such nippers have developed along two principal lines, the first providing some type of a mechanically rotated nipper element adapted to strike with some impact upon the lip of a pre-positioned oyster and the second providing a mechanically oscillated blade or needle for insertion through the lip of an oyster to sever or tear the adductor muscle from the valves. The instant invention in contradistinction, though it may be used industrially, is designed and adapted particularly for battery powered operation by private, non-industrial users desiring to shuck oysters for individual use aided by an appropriately priced tool.

Rotary type nipping devices have generally provided a nipping element that rotates continuously to have mechanical efficiency. This type of element tends to generate small pieces of oyster shell which may remain with the oyster meat and often the devices may cause multiple nipping of an oyster shell to increase the problem. The rotary type nippers generally must provide some contained area in which the nippers move to provide for the safety of users, and this often presents a problem as the rapidity of the nipping operation and the irregular configuration of oyster shells may not allow proper placement of an oyster within the nipping area.

The oscillating knife or needle type devices normally do not nip an oyster shell and generally have not been easier to insert between the valves than an ordinary manually operated oyster shucking knife. They present little, if any, improvement and their difficulty of insertion which tends to cause the insertable element to move in erratic fashions to increase the probability of worker injury.

In contradistinction, the instant nipper provides a discrete, as opposed to a continuous, mechanical operation so that the nipping operation is instituted for each individual oyster after the oyster is satisfactorily positioned within the nipping device. The nipping also is accomplished in one rather than multiple operations to avoid excessive fragmentation of shell portions which might become mixed with the oyster meat.

My invention resides not in any one of these features individually, but rather in the synergistic combination of all of the structures of my nipper that necessarily give rise to the functions flowing therefrom as specified and claimed.

SUMMARY OF INVENTION

My invention provides a peripherally defined handle structure interconnecting a peripherally defined nipper body in an angulated orientation for substantially vertical positioning when the handle is manually held. The nipper body defines an elongate chamber with a nipper orifice communicating through the body to the chamber in its lower portion, diametrically opposed from interconnection of the body with the handle. The internal chamber slidably carries a nipper plunger biased downwardly toward the nipper orifice by a compression spring. The nipper plunger carries a depending nipper blade for vertical motion in the lower portion of the body chamber to nip the lip of an oyster within the nipper orifice. A bell crank mounted in the lower portion of the handle structure communicates with the nipper plunger to move that plunger upwardly against its bias and release it to move downwardly adjacent the nipping orifice by reason of its bias to nip the lip of an oyster.

In a first manually operated species, the bell crank is moved by a lever and dog linkage that moves a rotating cam carried within the handle structure. In a second powered species, a solenoid carried in the handle structure moves the bell crank for similar operation of the nipper plunger. The solenoid is powered by rechargeable batteries carried within the handle structure and is operated by a switch projecting from the handle.

In providing such a device, it is:

A principal object to provide a hand-held oyster nipper that has the tubular nipper body defining a nipping orifice in its lower portion for positioning of the anterior lip of an oyster for nipping to provide a notch to aid insertion of a shuck knife.

A further object is to provide such a nipper wherein a plunger is slidably moved away from the nipping orifice against the bias of a compression spring and thereafter released so that a nipping blade depending from the plunger is impelled by the kinetic energy of the spring with substantial speed and force to cause the nipping operation.

A still further object is to provide such a nipper wherein the nipper plunger is moved by a bell crank that may be manually operated in a first species by a mechanical gripping lever that moves a cam and dog linkage or in a second species by an electrically powered solenoid that is controlled for discrete operation by a switching device.

A still further object is to provide such a nipper that is of new and novel design, of rugged and durable nature, of simple and economic manufacture and otherwise well adapted for the uses and purposes for which it is intended.

Other and further objects of my invention will appear from the following specification and accompanying drawings which form a part hereof. In carrying out the objects of my invention, however, it is to be understood that its accidental features are susceptible of change in design and structural arrangement, with only the preferred and practical embodiment of the best known mode being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figure 2:
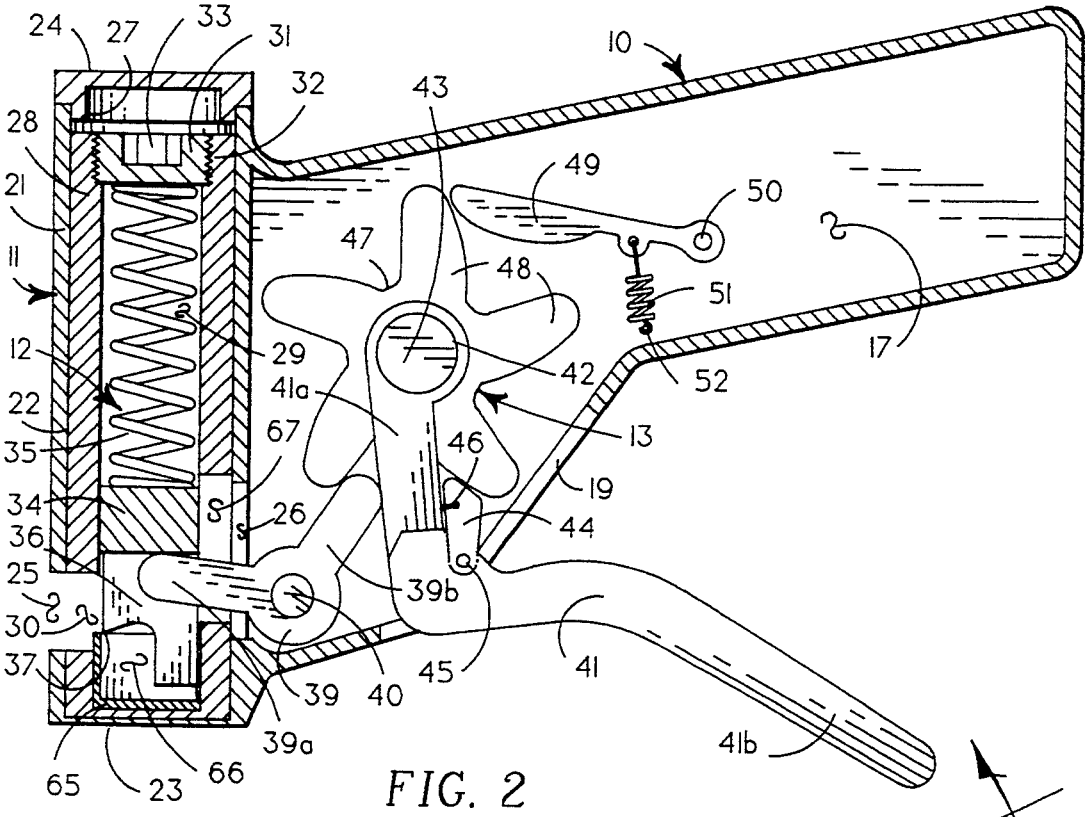
FIG. 2 is an enlarged vertical cross-sectional view through the nipper of FIG. 1, taken on the line 2—2 thereon in the direction indicated by the arrows, to show details of the parts and internal structure of a first manually operable species.

My oyster nipper in general provides peripherally defined handle 10 angularly interconnecting nipper body 11 that defines an internal channel to carry nipper mechanism 12 for manual operation in a first species by linkage 13 and for powered operation in a second species by linkage 14.

Figure 1:
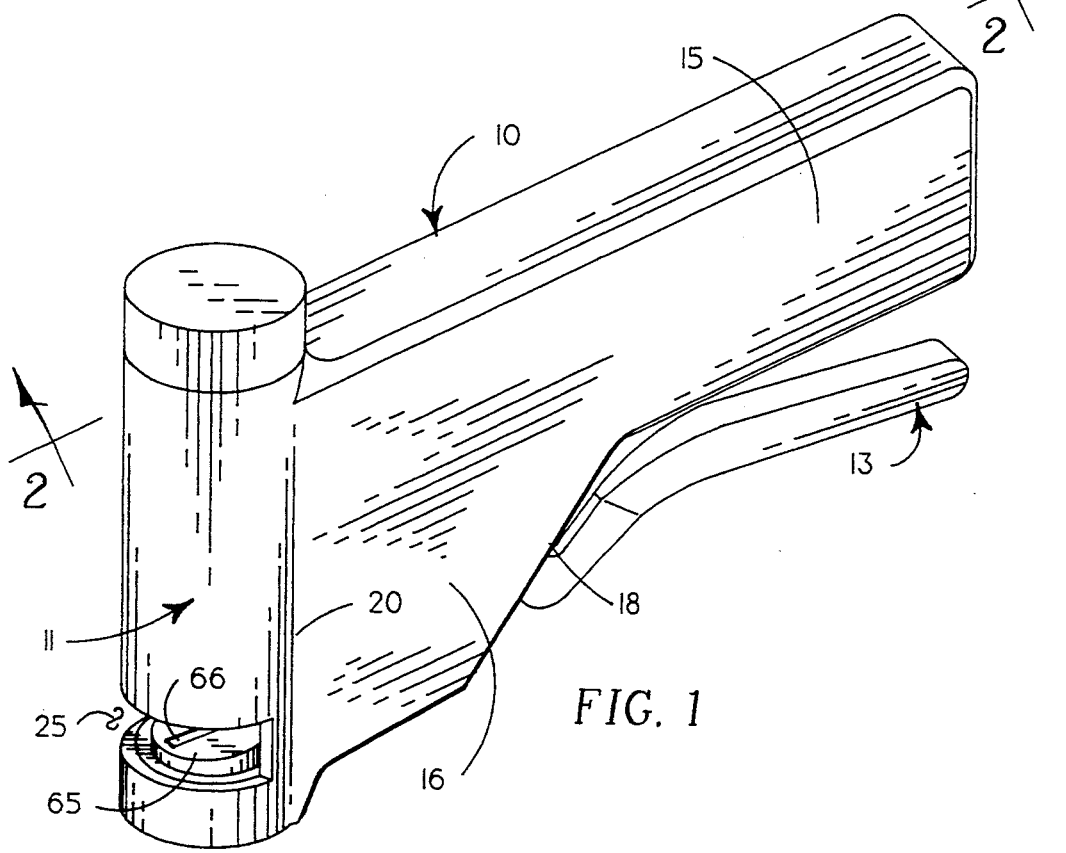
FIG. 1 is an isometric surface view of the first manually operated species of my nipper showing its various structural members, their configuration and relationship.

As illustrated in FIGS. 1 and 2, handle 10 is an elongate peripherally formed rigid element having smaller rearward portion 15 and larger forward portion 16 defining inner chamber 17. The lower surface of the handle, in the transition area 18 between the larger and smaller handle portions, defines orifice 19 to allow passage of operating mechanism of the device.

Nipper body 11 provides tubular element 21 defining elongate internal chamber 22 that is enclosed by bottom 23 and removable top 24 for placement of the operating mechanism therein. The nipper body is structurally joined to handle inner edge 20 which is configured to conformably interfit with the nipper body. Preferably, both the handle and nipper body are formed as a unitary structure. The forward portion of the nipper body, that is the surface diametrically opposed to the handle, defines nipping orifice 25 of appropriate vertical extent to receive therein the lip of an oyster to be nipped. The rearward or handle facing surface of the nipper body defines lower operating mechanism orifice 26 that communicates with the forward portion of chamber 17 of the handle. Removable top 24 preferably provides downwardly depending annular lip 27 to fit inwardly adjacent the nipper body structure to aid interconnection. In general after placement of nipper elements in channel 29, the top 24 is structurally joined to tubular element 21 by adhesion, thermal welding or the like, though if desired the adjacent vertical surfaces may be provided with releasable fastening means such as threads, cooperating indentations and protuberances, or similar structures.

Nipper mechanism 12 provides tubular nipper sleeve 28 defining internal channel 29. The nipper sleeve is carried in body chamber 22 to extend from a position spacedly below top 24 to bottom 23 and defines sleeve nipping orifice 30 that is substantially coincident with body nipping orifice 25. The rearward portion of the nipper sleeve defines operating linkage orifice 67 which is substantially coincident with operating linkage orifice 26 defined in the body. The nipper sleeve is positionally maintained in the lower portion of body channel 22, in the instance shown by structural joinder such as adhesion or thermal welding, though it may also be maintained by a plug extending between the lower surface of top 24 and the upper surface of the nipper sleeve, which is within the ambit of my invention.

The lower portion of nipper channel 29 carries nipper anvil 65 which defines nipper blade channel 66 depending from its upper surface to receive the lower portion of a nipper. The upper portion of the nipper sleeve channel is closed by adjustable and removable nipper sleeve plug 31 which has threaded external surface 32 for engagement with cooperating threads defined in the upper portion of the upper sleeve channel. The upper medial portion of plug 31 defines indentation 33 of polyagonal cross-section to aid manipulation by an elongate tool insertable through the upper portion of body channel 22 when top 24 is removed.

Figure 3:
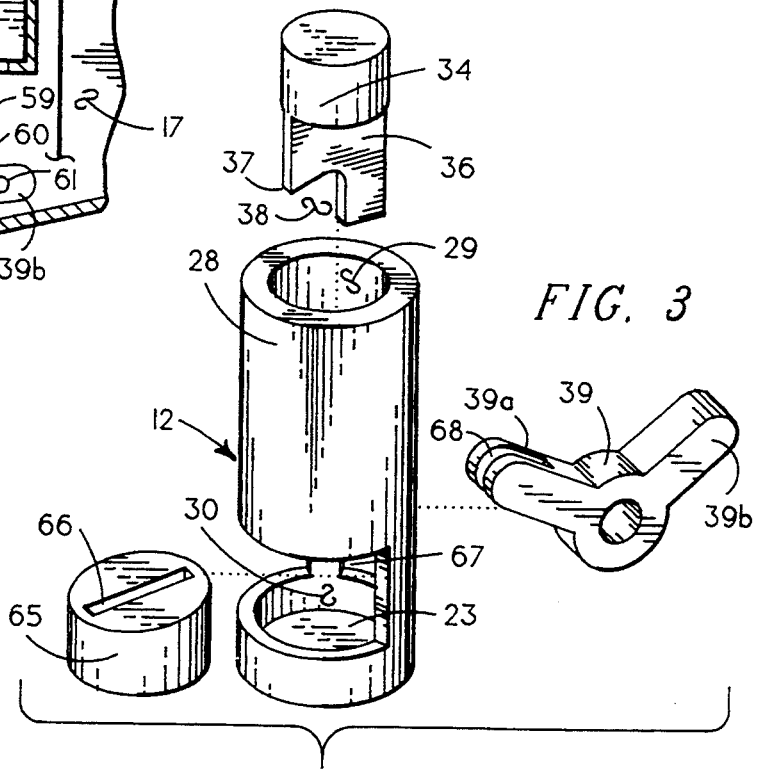
FIG. 3 is an expanded isometric view of the nipper elements to better show their configuration and relationship.

Nipper plunger 34 is slidably carried in nipper sleeve channel 29, with compression spring 35 extending between the upper portion of the nipper plunger and the lower surface of the nipper sleeve plug 31. As seen in FIG. 3, the nipper plunger carries depending nipper 36 which is a plate-like element having a lower forward portion removed to define forward nipping edge 37 and upward and inwardly sloping nipping notch 38 to aid in positionally maintaining an oyster lip relative to the nipping edge during the nipping operation. The nipping edge 37 is configured to fit immediately radially inward of the inner surface of nipper sleeve 28 and within channel 66 of the nipper anvil so that the nipping operation may be accomplished between the nipping edge and the upper surface of the nipping anvil.

The nipper mechanism is operated by bell crank 39 having relatively angulated forwardly extending body arm **39*a* and rearwardly extending handle arm 39*b*. The bell crank 39 is pivotally mounted on bell crank pin 40 extending between the lateral sides of larger inner element 16 of the handle. The length of body arm 39*a* is substantially as illustrated in FIG. 2, so that the body arm remains beneath the lower surface of nipper plunger 34 during its vertical motion. The body arm 39*a* defines medial channel 68 to allow slidable motion of the nipper 36** therethrough and to maintain alignment during motion.

Manual operating linkage 13 provides "L" shaped operating lever 41 with journalling arm **41*a* carried within internal chamber 17 of the handle and lever arm 41*b* extending externally of the handle in somewhat angulated orientation to the lower surface of smaller outer portion 15 of the handle. The journalling arm 41*a* in its inner end portion defines hole 42 for rotatable support on operating lever pin 43 that extends in chamber 17 between the lateral sides of the larger inner portion 16 of the handle in a position such that an operating cam carried thereon operatively communicates with the bell crank 39. The operating lever at the juncture between its two arms pivotally mounts operating lever dog 44 on pin 45. The operating lever dog is biased by extension spring 46 to the position shown in FIG. 2, and it is prevented from moving in a counter-clockwise direction against its bias beyond this point by reason of its contact with the operating lever 41**.

Operating lever pin 43 rotatably journals operating cam 47 having radially extending fingers 48. Knife-shaped operating cam dog 49 is pivotally carried on pin 50 which in turn is supported in handle chamber 17 by the adjacent lateral portions of smaller outer handle element 15. The operating cam dog 49 is biased toward a downward position by extension spring 51 communicating between the dog 49 and extension spring pin 52 carried between the lateral sides of the handle.

These various operating linkage elements are configured and positioned substantially as illustrated in FIG. 2, with bell crank 39, operating lever dog 44, operating cam 47 and operating cam dog 49 all in substantially coplanar contact to accomplish the results required of them. The journalling arm **41*a* of the operating lever is carried laterally adjacent to the plane of the immediately aforesaid elements, but the operating lever dog 44 has sufficient width or lateral extension that it contacts the rearward facing surface of journalling arm 41*a* while its pivotally outer portion contacts one of the fingers 48 of operating cam 47**.

Having thusly described the first manual species of my nipper, its operation can be understood, especially with reference to FIGS. 4A–4D.

The nipper is shown in its null position in FIG. 4A with compression spring 35 of the nipper mechanism relaxed and nipper plunger 34 in its lower position, which places the nipper edge 37 immediately radially inwardly and slightly below the upper surface of nipper anvil 65. In this condition, the nipper is manually grasped by a user with the palm of the hand on the upper surface of smaller outer handle element 15 and the fingers extending about the lower surface of adjacent operating lever 41.

Figure 4B:
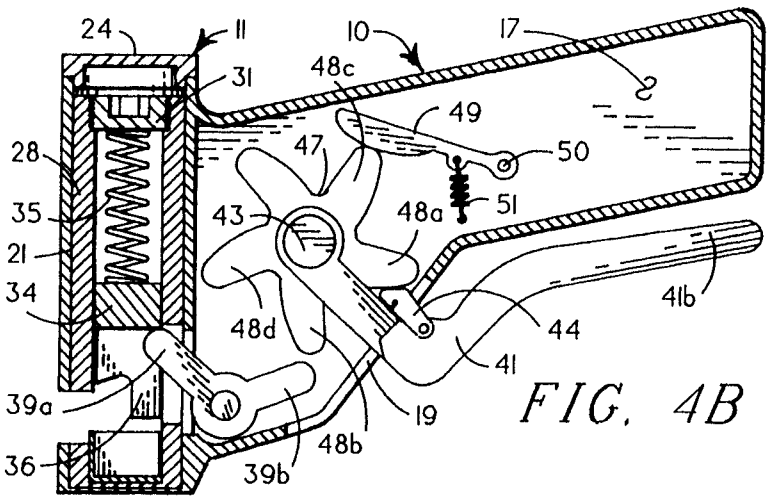
FIGS. 4A, 4B, 4C and 4D are somewhat reduced cross-sectional views, similar to that of FIG. 2, showing the operating mechanism in different stages to illustrate its operation.

The operating lever is then moved by force of a user's fingers toward the smaller outer element 15 of the handle to a position as illustrated in FIG. 4B. As this occurs, the operating cam 47 will be pivoted in a counter-clockwise direction by reason of operating lever dog 44 contacting operating cam finger 48*a*. This operating cam motion will continue as lever arm 41*b* is moved toward the handle to responsively pivot the operating cam in a counter-clockwise direction so that cam finger 48*b* moves handle arm 39*b* of the bell crank in a clockwise direction to responsively move nipper plunger 34 upwardly to partially compress spring 35 and store potential energy in it. This action continues until substantially the condition illustrated in FIG. 4B is attained.

As illustrated in FIG. 4B, the operating cam finger 48*b* continues moving until it no longer contacts handle arm 39*b* of the bell crank, when the bell crank will be freed from constraint preventing it from rotating in a counter-clockwise direction. The bell crank then will then pivot counter-clockwise responsive to downward motion of the nipper plunger carried by the potential energy stored in compression spring 35. As this occurs, nipper plunger 34 will move downwardly to move the nipper 36 to the position illustrated in FIG. 4C and thusly in the process move nipper edge 37 through the lip of an oyster (not shown) carried in nipping orifices 25, 30.

Figure 4D:
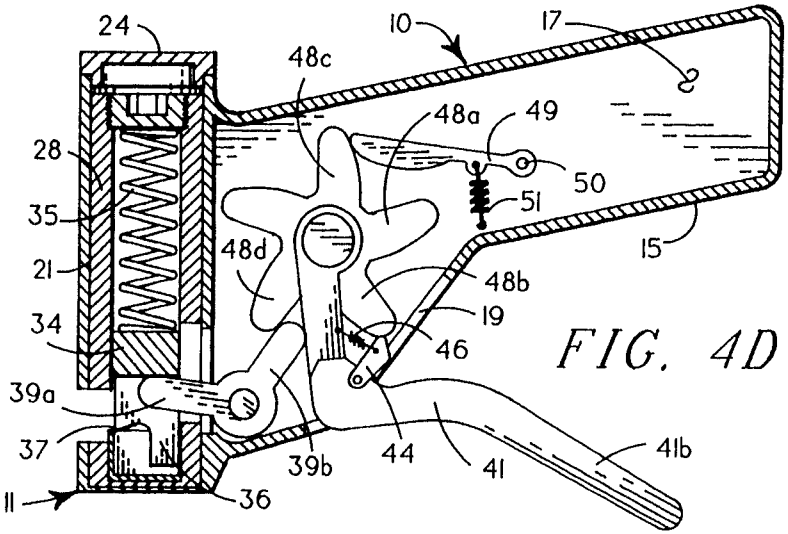
Figure 4A:
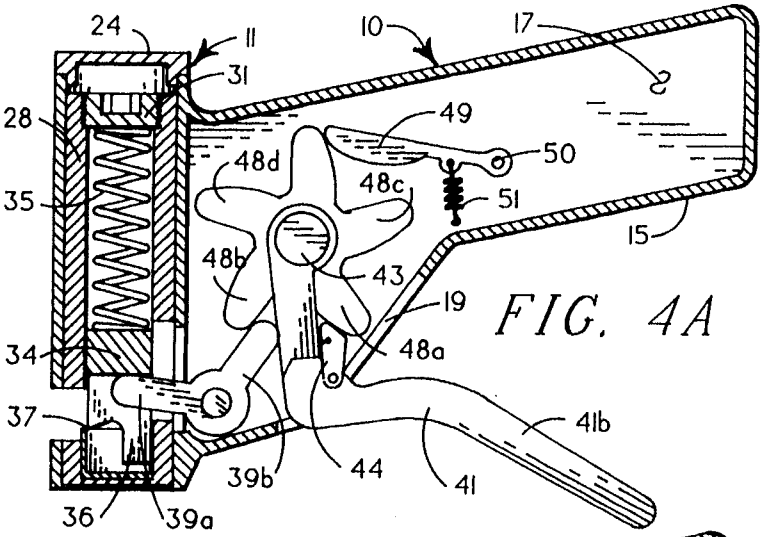
Figure 4C:
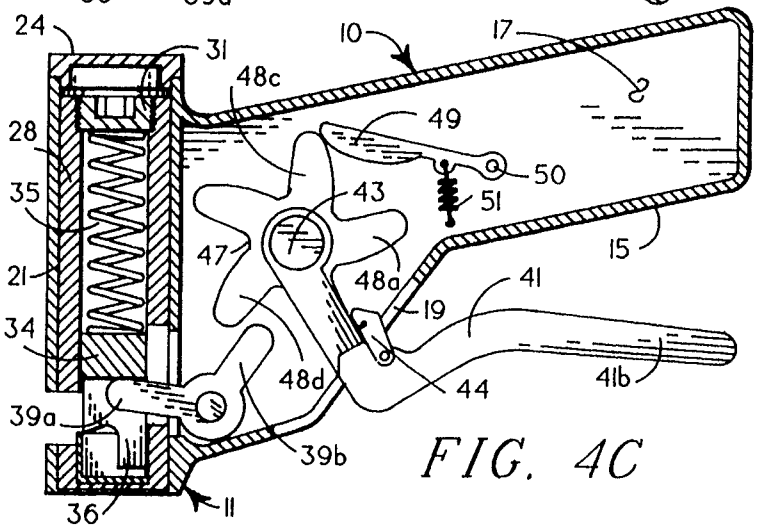

As this action occurs, operating cam finger 48*c* will have moved to contact the forward nipper facing surface of operating cam dog 49, as illustrated in FIG. 4C, to rotate the operating cam further in a counter-clockwise direction so that it assumes the position illustrated in FIG. 4C, with finger 48*d* now in the position of finger 48*b* when the operation started, with its lower surface adjacent the upper surface of body arm 39*b* of the bell crank. As the operating cam dog 49 moves by reason of bias from spring 51, it rotates the operating cam counter-clockwise, so that as operating lever 41 is released to its null position the operating lever dog 44 pivots sufficiently to move in a clockwise direction over the radially outer end portion of finger 48*b*, as illustrated in FIG. 4D so that the tool then is reset in a null position ready for recycling in the same fashion.

Figure 5:
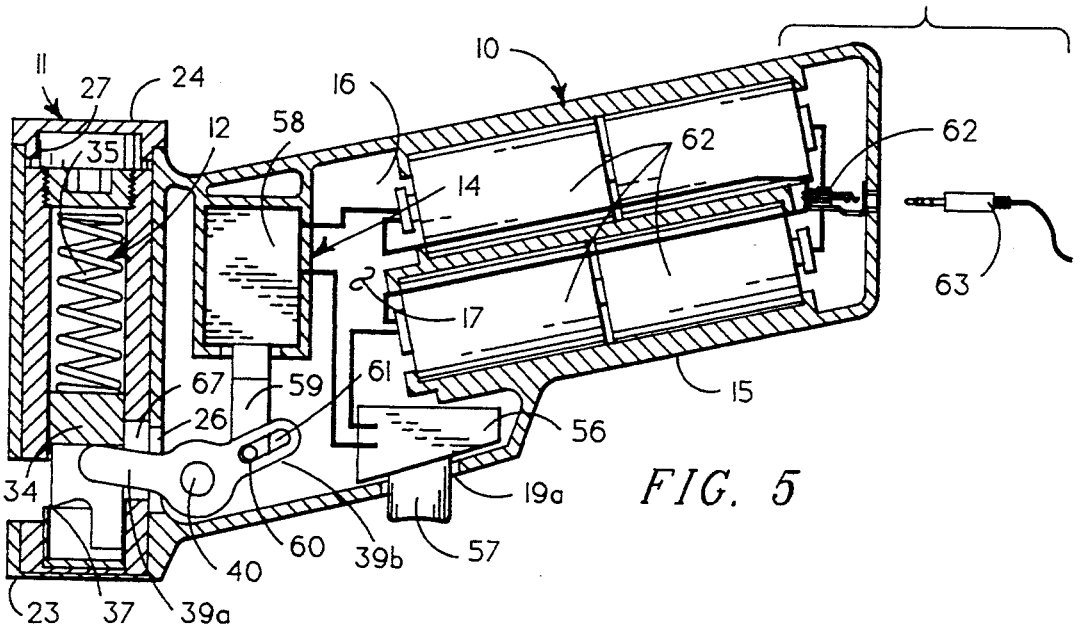
FIG. 5 is a vertical medial cross-sectional view, taken on a line similar to the line 2—2 on FIG. 1, to show the parts and internal structure of a second electrically powered species of my nipper in relaxed position.
Figure 6:
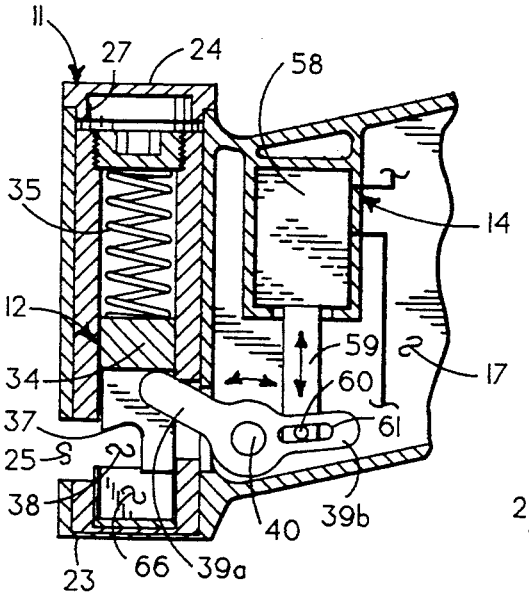
FIG. 6 partial view of the left portion of the device of FIG. 5, showing the operative mechanism in a compressed position ready for release.

A second electrically powered species of my nipper is illustrated in FIGS. 5 and 6. In this species, the handle 10, body 11, and nipper mechanism 12 are the same as in the first species, but the operating linkage is different.

The electrically powered operating linkage 14 operates bell crank 39 having a body arm 39*a* and handle 39*b* pivotally carried on pin 40 as in the first species.

Push type operating switch 56 is carried in handle chamber 17 with its operative button 57 extending from the handle structure through orifice 19*a* for operative access. Solenoid 58 is carried in the portion of handle chamber 17 defined in the larger inner portion 16 of the handle. This solenoid provides depending operating rod 59 movably communicating by headed pin 60, carried by its lower end portion with slot 61 defined in the radially outer portion of bell crank handle arm 39*b*, for combined sliding and pivotal motion. Operating rod 59 of the solenoid is biased upwardly or to a non-extended position, but movable against its bias to a lower extended position upon solenoid operation responsive to operation of switch 56.

The portion of chamber 17 defined by the smaller outer handle element 15 carries batteries 62 which furnish electrical power to power solenoid 58. Preferably these batteries are of rechargeable type and are electrically interconnected to fixture 62 that communicates through the outer wall of the handle element 15 to allow electrical contact with plug 63 of a recharging unit (not shown).

Having thusly described the structure of the second electrically powered species of my nipper, its operation may be understood, especially with reference to FIG. 6 of the drawings.

A user manually grasps the handle of the nipper and the lip of an oyster to be nipped is inserted with the other hand into the nipping orifices 25, 30. With the nipper and oyster in this relationship, button 57 is pressed with a finger of the hand holding the nipper handle to activate switch 56 that completes the electrical circuit between powering batteries 62 and solenoid 58. The solenoid 58 operates to extend operating rod 59 in a downward fashion with some rapidity and force. This motion is transmitted to handle arm 39*b* of the bell crank to pivot that handle arm in a clockwise direction and thusly move body arm 39*a* correspondingly to move nipper plunger 34 upwardly and compress compression spring 35. As button 57 is released to deactivate the solenoid, the bell crank 39 will be free to pivot and the plunger 34 will move to its initial lowermost position, as illustrated in FIG. 5. As this occurs, the nipper edge 37 will be moved to the position illustrated in FIG. 5 and the lip of an oyster in the nipping channel will be nipped similarly to the first manual species of my nipper. The device then will be in a null position and ready for recycling as before described.

It should be particularly noted that in either species of my nipper the nipper plunger and nipper blade are moved downwardly toward the lip of an oyster carried in the nipper orifices with some rapidity and force by reason of the release of the kinetic energy in compression spring 35. This action tends to cause better severing and breaking action in the nipped portion of the oyster valves than is caused by compressive force that extends over a longer period of time for its application. More rapidly applied force also tends to shatter pieces of oyster shell less readily than force that is applied over a longer period of time. Also in general, the shorter the period of time of application of force to an oyster shell for nipping the less force will be required to accomplish this result.

It should also be noted that the configuration and sizing of the nipping orifice defined in the body of my nipper may be varied to accommodate mollusks of particular type, size and shape and such variations are within the ambit and scope of my invention. The size and shape of the nipping edge 37 may also be varied within limits to accommodate particular types and sizes of oysters and shucking knives, but in general the nipped area of an oyster lip should be as small as practically feasible to allow the insertion of a shucking knife therein, as the force required to accomplish nipping varies somewhat directly with the area that is nipped.

The foregoing description of my invention is necessarily of a detailed nature so that a specific embodiment of its best known mode might be set forth as required, but it is to be understood that various modifications of detail, rearrangement and multiplication of parts might be resorted to without departing from its spirit, essence or scope.

Having thusly described my invention, what I desire to protect by Letters Patent and

What I claim is:

1. A nipper tool to remove a peripheral portion of the lip of a bivalve mollusk shell to aid insertion of a knife between the valves for butchering, comprising in combination:

a handle defining an internal chamber, a first orifice for connection with a nipper body and a second orifice for passage of operating mechanisms;

a nipper body carried by the handle, said nipper body defining an internal channel, a nipping orifice communicating with the internal channel, and an operating linkage orifice communicating between the internal channel of the nipper body and the internal chamber of the handle;

nipper mechanism carried in the internal channel of the nipper body including a nipper anvil in the lower portion of the channel, a nipper plunger slidably carried thereabove with a depending nipper blade movable in the internal channel adjacent the nipping orifice, a compression spring above the nipper plunger maintained in the internal channel by a removable top to bias the nipper plunger downwardly, and a bell crank pivotally carried in the handle internal chamber with a body arm extending into the nipper sleeve channel to move the the nipper upwardly against the bias of the compression spring and release it to move downwardly to nip the lip of a mollusk in the nipping orifices; and means of operatively moving the bell crank.

2. The nipper tool of claim 1 wherein the means of operatively moving the bell crank comprises:

the bell crank communicating with a finger cam pivotally carried in the handle internal chamber for rotation by a lever projecting from the handle, to move the bell crank and subsequently release it.

3. The nipper tool of claim 1 wherein the means of operatively moving the bell crank comprises:

the bell crank communicating with a solenoid carried within the handle internal chamber to move the bell crank and subsequently release it; and electrical means to power the solenoid and control means to control operation of the solenoid.

4. A nipper tool to remove a peripheral portion of the lip of a bivalve mollusk shell to aid insertion of a knife between the valves for shucking, comprising in combination:

a peripherally formed handle having a smaller outer portion and a larger inner portion defining an internal channel, a first orifice in the larger inner portion having an inner edge for connection with a nipper body, and a second operating mechanism orifice for passage of operating mechanism from the chamber;

an elongate peripherally formed, cylindrical nipper body carried by the inner edge of the first orifice of the handle, said nipper body defining an internal channel, a nipping orifice communicating with the internal channel through the body in its lower portion diametrically opposed to the handle, and an operating linkage orifice communicating from the internal channel to the handle internal chamber;

nipper mechanism carried in the internal channel of the nipper body comprising a nipper sleeve defining an internal channel and a nipping orifice substantially coextensive with the nipping orifice defined by the body, said nipper sleeve internal chamber carrying a nipper anvil in its lower portion, a nipper plunger slidably carried thereabove with a depending nipper blade movable in the nipper sleeve internal channel adjacent the nipping orifice, and a compression spring above the nipper plunger maintained in the nipper sleeve channel by a removable nipper sleeve plug, and a bell crank pivotally carried in the chamber defined by the larger handle portion and having a first body arm extending into the nipper sleeve internal channel below the nipper plunger and a second angulated handle arm extending into the handle chamber to pivot to responsively move the nipper plunger upwardly against bias created by the compression spring and release the nipper plunger for downward motion to nip the the lip of a mollusk carried in the nipping orifices defined by the nipper body and nipper sleeve; and manual operating mechanism, carried in the handle internal chamber to communicate with the handle arm of the bell crank, comprising a finger cam pivotally carried for rotation by an operating lever projecting from the handle to move the bell crank to responsively move the nipper plunger upwardly and subsequently release it for downward motion responsive to bias of the compression spring.

5. A nipper tool to remove a peripheral portion of the lip of a bivalve mollusk shell to aid insertion of a knife between the valves for shucking, comprising in combination:

a peripherally formed handle having a smaller outer portion and a larger inner portion defining an internal channel, a first orifice in the larger inner portion having an inner edge for connection with a nipper body, and a second operating mechanism orifice for passage of operating mechanism from the chamber;

an elongate, peripherally formed cylindrical nipper body carried by the inner edge of the first orifice of the handle, said nipper body defining an internal channel, a nipping orifice communicating with the internal channel through the body in its lower portion diametrically opposed to the handle, and an operating linkage orifice communicating from the internal channel to the handle internal chamber;

nipper mechanism carried in the internal channel of the nipper body comprising a nipper sleeve defining an internal channel and a nipping orifice substantially coextensive with the nipping orifice defined by the body, said nipper sleeve internal channel carrying a nipper anvil in its lower portion, a nipper plunger carried thereabove slidably with a depending nipper blade movable in the nipper sleeve internal channel adjacent the nipping orifice, and a compression spring above the nipper plunger maintained in the nipper sleeve channel by a removable nipper sleeve plug, and a bell crank pivotally carried in the chamber defined by the larger inner portion and having a first body arm extending into the nipper sleeve internal channel below the nipper plunger and a second angulated handle arm extending into the handle chamber to pivot to responsively move the nipper plunger upwardly against bias created by the compression spring and release the nipper plunger for downward motion to nip the lip of a mollusk carried in the nipping orifices defined by the nipper body and nipper sleeve; and electrically powered operating mechanism carried in the handle chamber comprising a solenoid having an operating rod articulatingly communicating with the bell crank to pivot the bell crank to responsively move the nipper plunger upwardly and subsequently release it for downward motion responsive to bias of the compression spring, and electrical powering means to operate the solenoid and control means.

* * * * *